US006731117B1

(12) United States Patent
Slough

(10) Patent No.: US 6,731,117 B1
(45) Date of Patent: May 4, 2004

(54) TEST PIN FOR POWER RECEPTACLES

(76) Inventor: David Slough, Route 2, Box 2367, Elkhart, TX (US) 75839

( * ) Notice: Subject to any disclaimer, the term of this patent is extended or adjusted under 35 U.S.C. 154(b) by 48 days.

(21) Appl. No.: 10/104,418

(22) Filed: Mar. 25, 2002

(51) Int. Cl.[7] ..... H01H 31/04
(52) U.S. Cl. ..... 324/538
(58) Field of Search ..... 324/538, 72.5, 324/149, 754, 761, 755, 133; 439/133

(56) References Cited

U.S. PATENT DOCUMENTS 4,321,532 A * 3/1982 Luna ..... 324/761

* cited by examiner

*Primary Examiner*—Albert Decady
*Assistant Examiner*—James Kerveros
(74) *Attorney, Agent, or Firm*—Harrison & Egbert

(57) ABSTRACT

A test pin for an electrical receptacle having a conductive terminal, a non-conductive housing affixed to an end of the conductive terminal, and a receptacle affixed within the housing adjacent an end of the housing opposite the terminal. The receptacle is electrically connected to the conductive terminal. The conductive terminal is a tubular member having an end threadedly engaged with the housing. The receptacle is of an electrically conductive material and mounted entirely within the non-conductive housing. A wire has a first end affixed to the receptacle and a second end affixed to an end of the housing. The test pin is suitable for slidable receipt within the interior of a sleeve of the electrical receptacle.

13 Claims, 2 Drawing Sheets

TEST PIN FOR POWER RECEPTACLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to pin and sleeve electrical connectors. More particularly, the present invention relates to test pins for testing the electricity in a receptacle with a meter. More particularly, the present invention relates to test pins used for the convenient measurement of electricity.

BACKGROUND OF THE INVENTION

Pin and sleeve types of electrical connectors have been developed for a variety of special applications and have proven to be extremely useful and advantageous for a number of reasons. The descriptive name for this type of connector is derived from the construction of male and female connector portions wherein the electrical contacts in the male part, or a plug, are two or more cylindrical, solid, electrically conductive pins which are mounted in the body of the plug and the contacts in the female part, or receptacle, or a corresponding number of electrically conductive sleeves. The pins in the plug are surrounded by a substantially cylindrical protective shroud. The receptacle portion of such a connector includes a generally cylindrical insulating inner body having tubular recesses with the elongated conductive sleeves to receive the pins and a shell which is spaced from the insulating body, leaving an annular gap to receive the shroud. The shroud and shell are provided, respectively, with a key and slot so that the orientation of the shroud with respect to the shell, and with respect to the pin-receiving body of the receptacle, is clearly established.

Additionally, the ground pin of the plug portion of the connector is always larger in diameter than other pins and the conductive sleeve to receive the ground pin in the receptacle body not only is suitably sized to receive the pin but also reaches further toward the open end of the body than the conductive sleeves adapted to receive the other pins, thereby permitting a ground connection to be established before any other electrical connection is made.

Pin and sleeve connectors have numerous advantages including the fact that the pin arrangements can be made in a variety of configurations, each configuration being unique to a particular set of voltage, phase and current characteristics. The shroud, as mentioned above, protects the pins from damage and protects the user from accidental contact with the pins. Normally, the receptacle carries the power which is supplied to the plug. Thus, the shroud enters the annular cavity in the receptacle before the power is applied to the pins, providing a further safety feature. The shroud construction tends to exclude foreign materials and the overall construction has been found to be highly durable and reliable.

Unfortunately, it is often very difficult for electricians to properly test the power that is carried in the receptacle.

Under usual circumstances, the electrician would have to remove the housing around the receptacle in order to make measurements from the measuring leads of a meter. This is often a very difficult and time consuming procedure. Also, there are safety hazards involved whenever the housing around the power-carrying receptacle must be removed. The electrician must be very cautious when testing the power in such an area. Under many circumstances, fatalities can occur when the electrician accidentally contacts a live wire within the receptacle.

It is an object of the present invention to provide a test pin for testing the electricity in the receptacle of a pin-and-sleeve connector.

It is another object of the present invention to provide a test pin which maximizes safety to the person testing the electricity in the receptacle.

It is a further object of the present invention to provide a test pin which achieves maximum efficiency in the testing of such receptacles.

It is a further object of the present invention to provide a testing apparatus which eliminates the need to remove the housing around the receptacle.

It is a further object of the present invention to provide a test pin for the electrical testing of a pin-and-sleeve type connector which is easy to use, relatively inexpensive and easy to manufacture.

These and other objects and advantages of the present invention will become apparent from a reading of the attached specification and appended claims.

BRIEF SUMMARY OF THE INVENTION

The present invention is a test pin for an electrical receptacle comprising a conductive terminal, a non-conductive housing affixed to an end of the conductive terminal and a socket affixed within the housing adjacent to an opening at the end of the housing opposite the conductive terminal. The socket is electrically connected to the conductive terminal.

The conductive terminal comprises a tubular member having a proximal end adjacent to the housing and a distal end. The proximal end is threadedly engaged within the end of the housing. The conductive terminal has an externally threaded surface at the proximal end. The housing has an internally threaded section at such end.

The socket is formed of an electrically conductive material. The socket is mounted entirely within the end of the housing opposite the terminal. A wire has a first end affixed to the socket and a second end affixed to an end of the terminal. The wire extends entirely within the housing.

In the testing of an electrical receptacle, such as those used in pin-and-sleeve connectors, the conductive terminal is inserted into the sleeve of the receptacle. The non-conductive housing will extend outwardly of the receptacle. The lead of a meter can then be inserted into the socket through the opening at the end of the housing opposite the end of the terminal. Separate test pin can be inserted into each of the sleeves within the electrical receptacle. Subsequent to testing, the test pins can be removed from the sleeves of the receptacle for use in other apparatus.

DETAILED DESCRIPTION OF THE INVENTION

Figure 1:
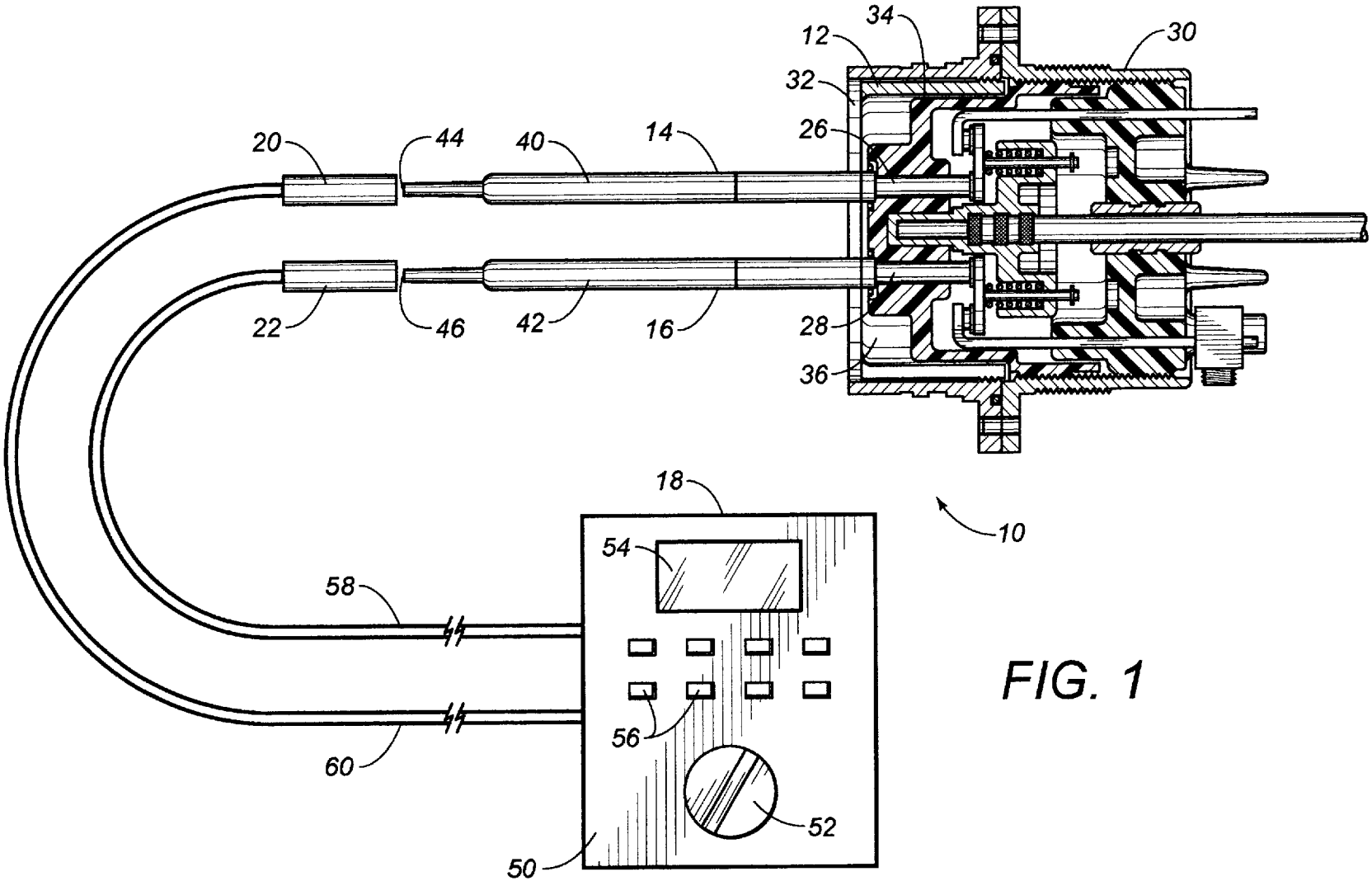
FIG. 1 is a partially cross-sectional view of the operation of the testing apparatus of the present invention.

Referring to FIG. 1, the testing apparatus 10 in accordance with the teachings of the present invention. The testing apparatus 10 of the present invention includes a power receptacle 12, a first test pin 14, a second test pin 16, and a meter 18 having leads 20 and 22 extending therefrom. As can be seen, first test pin 14 has a conductive terminal received within the sleeve 26 of the electrical receptacle 12. The second test pin 16 has its terminal received within the sleeve 28 of the electrical receptacle 12. The lead 20 of the meter 18 is connected into an end of the test pin 14 opposite the receptacle 12. Similarly, the lead 22 of the meter 18 is inserted into the end of the second test pin 16 opposite the receptacle 12. The meter 18 is electrically connected to each of the leads 20 and 22 so as to take suitable measurements therefrom.

The receptacle 12 is a pin-and-sleeve type connector receptacle. It is to be noted that, within the present invention, various types of such receptacles can be used within the concept of the present invention. The receptacle illustrated in FIG. 1 is a type which is presently manufactured and sold by Appleton Electric Company. However, it is important to note that various other types of such sleeve-type receptacles can be suitably tested through the use of the testing apparatus of the present invention.

The receptacle 12 includes a housing 30 extending therearound. Housing 30 has an opening 32 at a forward end thereof. Opening 32 exposes the sleeves 26 and 28 thereat. Insulating structure 34 supports the sleeves 26 and 28 on the interior 36 of the receptacle 12. In conventional usage, a pin-type plug would be inserted into the opening 32 so as to engage the sleeves 26 and 28. However, in the present invention, the conductive ends of the test pin 14 and 16 will be inserted into the sleeves 26 and 28 for the purposes of making electrical measurements from the receptacle 12. In the present invention, it will not be necessary to disconnect the receptacle 12 from any mounting arrangement. It is only necessary to insert the test pins 14 and 16 into the respective sleeves 26 and 28 for measurement purposes. The test pin 14 and 16 can be of various sizes so as to accommodate the various sizes of sleeves which are used in such receptacles.

In FIG. 1, the test pins 14 and 16 are shown as having non-conductive housings 40 and 42, respectively. The non-conductive housings can be formed of a TEFLON (TM) material. As will be described hereinafter, each of the housings 40 and 42 will be threadedly connected to the conductive end (illustrated as received within the sleeves 26 and 28). The housing 40 has an open end 44 at the end opposite the receptacle 12. Similarly, the housing 42 has an end 46 opposite the receptacle 12. The ends 44 and 46 each have an opening which allows the respective leads 20 and 22 of meter 18 to be inserted thereinto.

The meter 18 can be any of a variety of testing meters. As shown in FIG. 1, the meter 18 has an enclosure 50 with a dial 52, a display 54 and buttons 56. The buttons are suitable for making various electrical measurements. The display 54 will provide a display of the quality or quantity of the electricity measured. The dial 52 can be set to various settings. Wire 58 extends outwardly of the meter 18 so as to connect with lead 22. Similarly, wire 60 extends from meter 18 so as to connect to lead 20.

Figure 2:
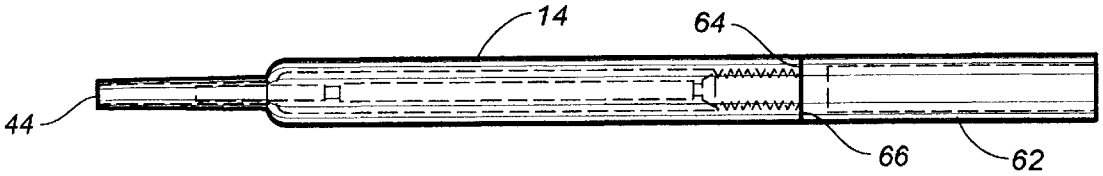
FIG. 2 is an isolated side elevational view of a test pin in accordance with the teachings of the present invention.

FIG. 2 is an isolated view of the test pin 14. This test pin 14 has a conductive end 62 at one end thereof. Similarly, test pin 14 has an opening at the end 44. The conductive terminal 62 is suitable for insertion into the sleeve 26 (or any other sleeves of the receptacle 12). The conductive terminal 62 has a proximal end 64 physically connected to end 66 of the housing 14. As will be described hereinafter, a threaded connection is established therebetween.

Figure 3:
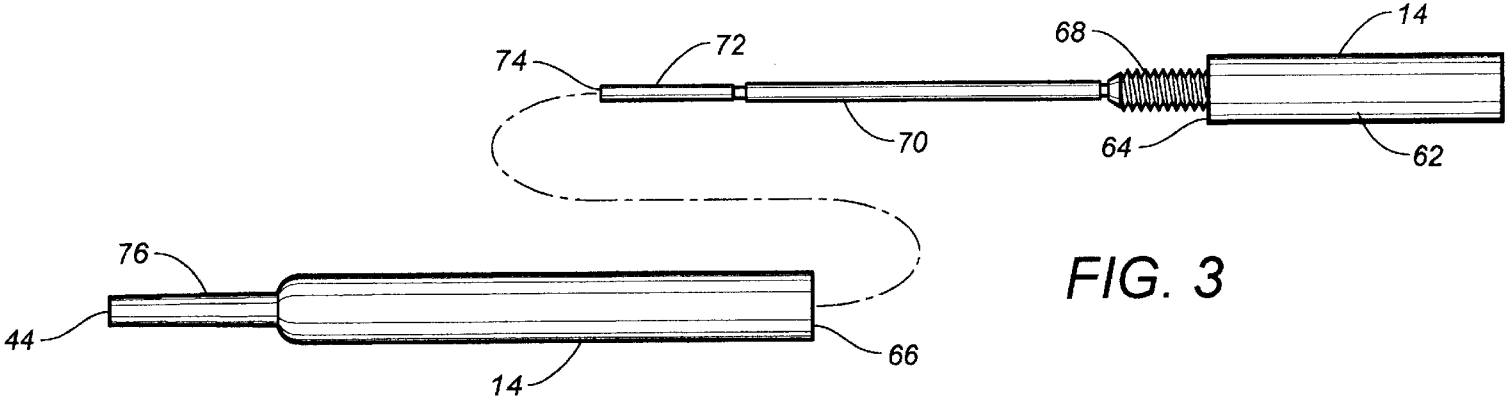
FIG. 3 is an exploded view showing the assembly of the test pin of the present invention.

FIG. 3 shows the interior arrangement of the test pin 14. The test pin 14 has conductive end 62 at one end thereof. The proximal end 64 of the conductive terminal 62 has an externally threaded section 68 at the proximal end 64. A wire 70 is electrically connected by soldering to the end of the externally threaded section 68 opposite the conductive terminal 62. A socket 72 is electrically connected to the end of the wire 70. Socket 72 is a tubular member having an opening at end 74 of a size suitable for snuggly receiving the lead from the meter 18.

As can be seen in FIG. 3, the housing 14 is fitted over the socket 72 and the wire 70/ The housing threadedly engages the externally threaded section 68 of the conductive terminal 62. When assembled, the socket 72 will extend into the nose portion 76 of the housing 14. The open end 74 will coincide with the open end 44 of the housing 14. The housing 14 can be suitably rotated so that an internally threaded section therein will engage the externally threaded section 68 so that the end 66 of the housing 14 will be snugly juxtaposed against the end 64 of the conductive terminal 62.

Figure 4:
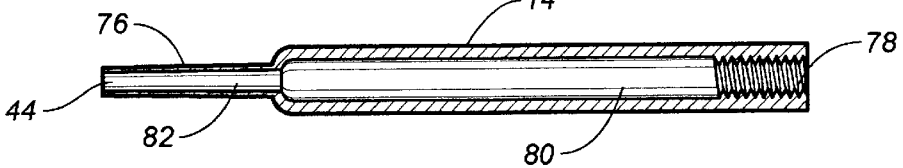
FIG. 4 is a cross-sectional view of the housing associated with the test pin of the present invention.

FIG. 4 shows a cross-sectional view of the interior of the housing 14. In particular, in FIG. 4, the internally threaded section 78 is illustrated. Internally threaded section 78 will have threads which threadedly mate with the externally threaded section 68. The wire 70 will extend through the interior passageway 80 of the housing 14. The socket 72 will fit into the narrow passageway 82 in the nose portion 76 of housing 14. The open end 74 of the socket 72 will be exposed to the open end 44 at the end of the nose section 76 of the housing 14. The lead 20 can then be inserted into the opening 44 so as to be received by the socket 72 and to be in electrical connection with the terminal 62 and the sleeve 26 of the receptacle 12.

The present invention achieves numerous advantages over prior methods of testing. Most importantly, it is only necessary for the electrician to grasp the non-conductive housing and insert the conductive terminal 62 into the sleeve associated with the receptacle of the pin-and-sleeve-type connectors. By inserting a lead into the socket associated with the test pin 12, the electrician can make accurate reading of the electricity within the receptacle. There is no need to disassemble any part of the receptacle in order to make these readings. As such, the electrical readings can be made in a safe, efficient and effective manner. Subsequent to testing, the various test pins inserted into the various sockets associated with the receptacle 12 can be pulled therefrom so that the socket can be ready for ordinary use. The test pin can then be used on other sockets for the purpose of further readings.

The foregoing disclosure and description of the invention is illustrative and explanatory thereof. Various changes in the details of the illustrated construction may be made within the scope of the appended claims without departing from the true spirit of the invention. The present inventi on should only be limited by the following claims and their-legal equivalents.

I claim:

1. A testing apparatus comprising:

a receptacle having a sleeve therein, said sleeve interconnected to a source of electricity, said sleeve having an interior diameter;

a test pin having a conductive end and a non-conductive end, said test pin having a socket electrically interconnected to said conductive end, said conductive end being slidably insertable into said sleeve of said receptacle; and a meter means having a lead extending therefrom, said meter means for measuring the electricity in said receptacle, said lead being insertable into said socket.

2. The apparatus of claim 1, said conductive end being a conductive terminal, said non-conductive end being a housing formed of an electrically non-conductive material, said non-conductive housing connected to an end of said conductive terminal, said socket affixed within an end of said housing opposite said terminal, said housing having an opening at said socket through which said lead extends.

3. The apparatus of claim 2, said conductive terminal comprising a tubular member having a proximal end adjacent said housing and a distal end away from said housing.

4. The apparatus of claim 3, said proximal end of said conductive terminal being threadedly engaged within said end of said housing.

5. The apparatus of claim 4, said conductive terminal having an externally threaded section at said proximal end, said housing having an internally threaded section at said end.

6. The apparatus of claim 2, said socket being of an electrically conductive material, said socket mounted entirely within said end of said housing opposite said terminal.

7. The apparatus of claim 6, further comprising:

a wire having a first end affixed to said socket and a second end affixed to said conductive end, said wire extending entirely within an interior of said test pin.

8. The apparatus of claim 1, said receptacle comprising a plurality of sleeves interconnected to said source of electricity, the apparatus further comprising:

a plurality of said test pins respectively received within said plurality of sleeves, said meter means having a pair of leads extending therefrom, one of said pair of leads received within the socket of one of said test pin, another of said pair of leads received within the socket of another of said plurality of test pins.

9. A testing apparatus comprising:

a meter having a first lead and a second lead extending therefrom;

a first test pin having a conductive end and a non-conductive end, said first test end having a socket electrically receptive to said conductive end, said first lead removably received within said socket; and a second test pin having a conductive end and a non-conductive end, said second test pin having a receptacle electrically interconnected to said conductive end, said second lead removably received within said receptacle of said second test pin.

10. The apparatus of claim 9, further comprising:

a first sleeve connected to a source of electricity, said conductive end of said first test pin removably received within said first sleeve; and a second sleeve electrically interconnected to the source of electricity, said second test pin removably received within said second pin.

11. The apparatus of claim 9, said conductive end and each of said first and second test pins being a conductive terminal, said non-conductive end of each of said first and second test pin being a housing formed of an electrically non-conductive material, said housing connected to an end of said conductive terminal, the socket being affixed within an end of said housing opposite said terminal, said housing having an opening at said socket through which the lead can extend.

12. The apparatus of claim 11, said conductive terminal comprising a tubular member having a proximal end adjacent said housing and a distal end, said proximal end of said conductive terminal being threadedly engaged within an end of said housing.

13. The apparatus of claim 9, further comprising:

a wire having a first end affixed to said socket and a second end affixed to said conductive end.

* * * * *